US010337400B2

(12) United States Patent
Okamoto et al.

(10) Patent No.: US 10,337,400 B2
(45) Date of Patent: Jul. 2, 2019

(54) VARIABLE COMPRESSION RATIO INTERNAL COMBUSTION ENGINE AND LEARNING METHOD THEREFOR

(71) Applicant: NISSAN MOTOR CO., LTD., Yokohama-shi, Kanagawa (JP)

(72) Inventors: Kazuhiko Okamoto, Kanagawa (JP); Eiji Takahashi, Kanagawa (JP); Ryousuke Hiyoshi, Kanagawa (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 15/738,897

(22) PCT Filed: Jun. 25, 2015

(86) PCT No.: PCT/JP2015/068292

§ 371 (c)(1),
(2) Date: Dec. 21, 2017

(87) PCT Pub. No.: WO2016/208024

PCT Pub. Date: Dec. 29, 2016

(65) Prior Publication Data

US 2018/0187594 A1 Jul. 5, 2018

(51) Int. Cl.

| | |
|---|---|
| ***F02B 75/04*** | (2006.01) |
| ***F02B 75/32*** | (2006.01) |
| ***F02D 15/02*** | (2006.01) |

(52) U.S. Cl.
CPC ..... *F02B 75/045* (2013.01); *F02B 75/32* (2013.01); *F02D 15/02* (2013.01)

(58) Field of Classification Search
CPC ..... F02B 75/045; F02B 75/32; F02D 15/00; F02D 15/02
See application file for complete search history.

(56) References Cited

U.S. PATENT DOCUMENTS 7,360,513 B2 4/2008 Takemura et al.
9,476,354 B2 * 10/2016 Hiyoshi ..... F02B 75/045
(Continued)

FOREIGN PATENT DOCUMENTS

JP 2006-226133 A 8/2006
JP 2011-169152 A 9/2011
(Continued)

*Primary Examiner* — Grant Moubry
(74) *Attorney, Agent, or Firm* — Foley & Lardner LLP

(57) ABSTRACT

A variable compression ratio internal combustion engine is equipped with a variable compression ratio mechanism configured to change an engine compression ratio in accordance with a rotational position of a control shaft, and a housing that accommodates therein a drive motor for changing and holding the rotational position of the control shaft. A reference position of the control shaft is learned in a state where a position of maximum rotation of the control shaft in a first rotational direction has been mechanically restricted by bringing a first movable part, which operates in conjunction with the control shaft, into abutted-engagement with a first stopper provided outside of an engine body. Subsequently, a maximum conversion angle range of the control shaft is learned in a state where a position of maximum rotation of the control shaft in a second rotational direction has been mechanically restricted by a second stopper.

5 Claims, 6 Drawing Sheets

(56) References Cited

U.S. PATENT DOCUMENTS

| | | | | |
|---|---|---|---|---|
| 9,482,161 | B2 * | 11/2016 | Nagai | F02B 75/045 |
| 9,797,307 | B2 * | 10/2017 | Onigata | F02D 15/02 |
| 2014/0290625 | A1 * | 10/2014 | Hiyoshi | F02B 75/32<br>123/48 R |
| 2018/0058314 | A1 * | 3/2018 | Okamoto | F02D 45/00 |

FOREIGN PATENT DOCUMENTS

| | | | |
|---|---|---|---|
| JP | 2012-132345 | A | 7/2012 |
| JP | 2012-251446 | A | 12/2012 |

* cited by examiner

VARIABLE COMPRESSION RATIO INTERNAL COMBUSTION ENGINE AND LEARNING METHOD THEREFOR

TECHNICAL FIELD

The present invention relates to an internal combustion engine equipped with a variable compression ratio mechanism, and specifically to learning of a reference position of a control shaft.

BACKGROUND ART

Patent document 1 discloses a technology in which a reference position of a control shaft is learned in a variable compression ratio internal combustion engine equipped with a variable compression ratio mechanism capable of changing an engine compression ratio in accordance with a rotational position of the control shaft. Concretely, the reference position is learned based on an output signal from a compression ratio sensor in a state where a movable part, which operates in conjunction with the control shaft, has been kept in abutted-engagement, with a stopper provided on a crankshaft bearing part that rotatably supports a crankshaft.

Patent document 2 discloses the detection of a reference position of a control shaft angle in a variable compression ratio internal combustion engine equipped with a variable compression ratio mechanism capable of changing an engine compression ratio in accordance with a rotational position of a first control shaft, while a portion of a second control shaft has been kept in abutted-engagement with a stopper provided on a housing.

CITATION LIST

Patent Literature

Patent document 1: Japanese Patent Provisional Publication No. JP2006-226133

Patent document 2: Japanese Patent Provisional Publication No. JP2011-163152

SUMMARY OF INVENTION

Technical Problem

However, in the Patent document 1, rotating parts that rotate together with a crankshaft, such as a crank pin, counterweights and the like, exist around the crankshaft bearing part, and thus restrictions on the layout are severe. Therefore, it is difficult to sufficiently ensure the strength and rigidity of the stopper provided on the crankshaft bearing part. For this reason, when the movable part, which operates in conjunction with the control shaft, is brought into abutted-engagement with the stopper, there is a necessity of limiting a torque by slowing down a speed of the movable part. This leads to the problem of increasing the time duration required for reference position learning.

Also, in the Patent document 2, the housing, on which the stopper is provided, is located outside of a cylinder block, and thus many link parts intervene between the stopper and a piston. This leads to the reference position accuracy problem such as a deteriorated reference position learning accuracy.

Furthermore, in learning the reference position of the control shaft, in addition to learning operation at a position of maximum rotation in one rotational direction of the control shaft, it is necessary to carry out learning operation at a position of maximum rotation in a reverse-rotational direction opposite to the one rotational direction of the control shaft.

It is, therefore, in view of the previously-described circumstances, an object of the present invention to shorten the time duration required for reference position learning without deteriorating the reference position learning accuracy.

Solution to Problem

A variable compression ratio internal combustion engine has a variable compression ratio mechanism capable of changing an engine compression ratio in accordance with a rotational position of a control shaft, a drive motor for changing and holding the rotational position of the control shaft, a first stopper provided outside of an engine body for mechanically restricting a position of maximum rotation of the control shaft in a first rotational direction by bringing a first movable part, which operates in conjunction with the control shaft, into abutted-engagement with the first stopper, and a second stopper provided inside of the engine body for mechanically restricting a position of maximum rotation of the control shaft in a second rotational direction opposite to the first rotational direction by bringing a second movable part, which operates in conjunction with the control shaft, into abutted-engagement with the second stopper. A reference position of the control shaft is learned in a state where the position of maximum rotation of the control shaft in the first rotational direction has been mechanically restricted by the first stopper. Subsequently, a maximum, conversion angle range of the control shaft is learned in a state where the position of maximum rotation of the control shaft in the second rotational direction has been mechanically restricted by the second stopper.

By virtue of the provision of the first stopper outside of the engine body, it is less restriction on the layout in comparison with such a case where the first stopper is provided inside of the engine body. Hence, it is easy to ensure the sufficient strength and rigidity. Therefore, it is possible to strongly and firmly provide the first stopper. Accordingly, it is unnecessary to slow down a speed of the first movable part for limiting a torque when the first movable part of the control shaft is brought into abutted-engagement with the first stopper. As a result of this, it is possible to shorten the time duration required for reference position learning without deteriorating the reference position learning accuracy. Additionally, the maximum conversion angle range of the control shaft is learned in a state where the position of maximum rotation of the control shaft in the second rotational direction has been mechanically restricted by the second stopper provided on a side of the second rotational direction opposite to the first rotational direction. Therefore, it is possible to more certainly eliminate individual differences of control shaft sensors manufactured, and consequently to improve the detection accuracy of an engine compression ratio. Additionally, the provision of the second stopper inside of the engine body contributes to fewer link parts intervening between the second stopper and the piston, in comparison with such a case where the second stopper is provided outside of the engine body. Thus, it is possible to improve the reference position learning accuracy.

Advantageous Effects of Invention

According to the present invention, it is possible to shorten the time duration required for reference positon learning without deteriorating the reference position learning accuracy.

DESCRIPTION OF EMBODIMENTS

Figure 1:
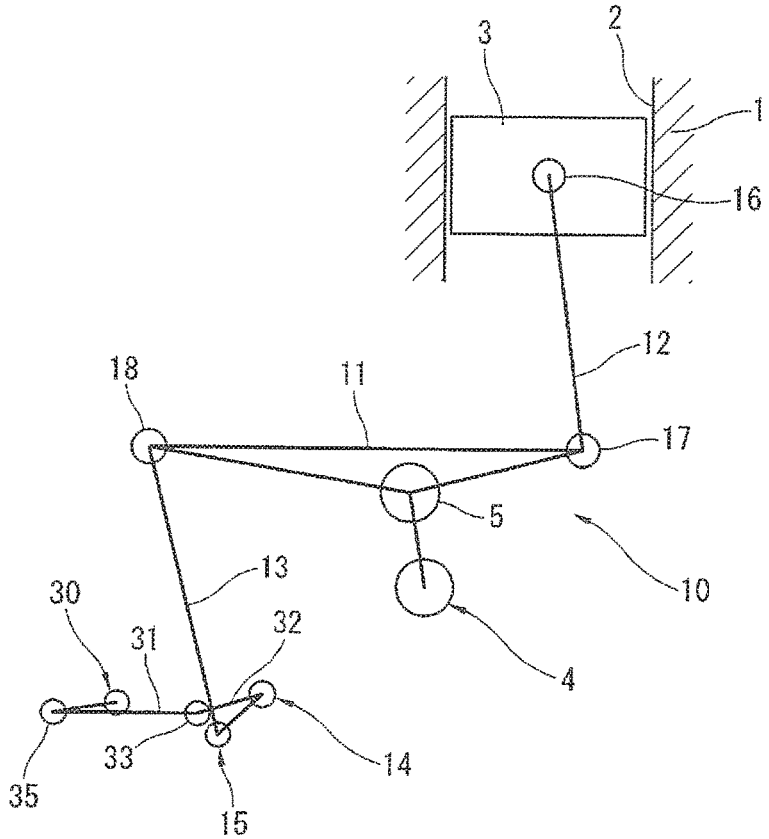
FIG. 1 is a diagram schematically illustrating the configuration of a variable compression ratio mechanism in one embodiment to which the invention is applied.

Hereinafter explained in detail in reference to the drawings are preferred embodiments of the present, invention. First of all, a variable compression ratio mechanism of one embodiment according to the invention, which utilizes a multilink piston-crank mechanism, is hereunder explained in reference to FIGS. 1 and 2. By the way, this mechanism itself has been set forth in the previously-discussed Japanese Patent Provisional Publication No. JP2006-226133 and is well-known, and thus it kept to a brief description.

A piston 3, which is provided for each individual cylinder, is slidably fitted into a cylinder 2 of a cylinder block 1 that constructs part of an engine body of an internal combustion engine. Also, a crankshaft 4 is rotatably supported by the cylinder block. A variable compression ratio mechanism 10 has a lower link 11, an upper link 12, a control shaft 14, a control eccentric shaft portion 15, and a control link 13. The lower link 11 is rotatably installed on a crankpin 5 of crankshaft 4. The upper link 12 mechanically links the lower link 11 to the piston 3. The control shaft 14 is rotatably supported on the engine body side, such as the cylinder block 1. The control link 13 mechanically links the control eccentric shaft portion 15 to the lower link 11. The piston 3 and the upper end of upper link 12 are rotatably linked together through a piston pin 16 so as to permit relative rotation between them. The lower end of upper link 12 and the lower link 11 are rotatably linked together through a first connecting pin 17 so as to permit relative rotation between them. The upper end of control link 13 and the lower link 11 are rotatably linked together through a second connecting pin 18 so as to permit relative rotation between them. The lower end of control link 13 is rotatably installed on the control eccentric shaft portion 15.

A drive motor 20 (see FIG. 2) is connected to the control shaft 14 via a connecting mechanism 21. An attitude change of lower link 11 occurs by changing and holding a rotational position of control shaft 14 by means of the drive motor 20. Owing to the attitude change of the lower link, a piston stroke characteristic including a piston top dead center (TDC) position and a piston bottom dead center (BDC) position changes, and thus an engine compression ratio changes. Therefore, the engine compression ratio can be controlled in accordance with an engine operating condition by driveably controlling the drive motor 20 by means of a control unit 40.

Control unit 40 is connected to various sensors, such as a control shaft sensor 41, an oil temperature sensor 42, an intake air temperature sensor 43, and the like. The control shaft sensor 41 is provided for detecting a rotational position of control shaft 14, corresponding to an engine compression ratio. The oil temperature sensor 42 is provided for detecting an oil temperature of the internal combustion engine. The intake air temperature sensor 43 is provided for detecting an intake air temperature. The control unit is configured to execute, based on output signals from these sensors, various engine controls, such as fuel injection control, ignition timing control, and the like. For instance, based on an output signal from the control shaft sensor 41, the control unit executes feedback control for the drive motor 20 in a manner so as to maintain the engine compression ratio closer to a target compression ratio.

A housing 22, in which part of the connecting mechanism 21 is housed, is located outside of an intake-side sidewall 7 of an oil-pan upper 6A fixed to the lower section of cylinder block 1 and constructing part of the engine body. The housing 22 and the drive motor 20, which is mounted to the housing, are both arranged along the engine longitudinal direction. That is to say, drive motor 20 is mounted onto the cylinder block 1, serving as part of the engine body, via the housing 22.

Figure 2:
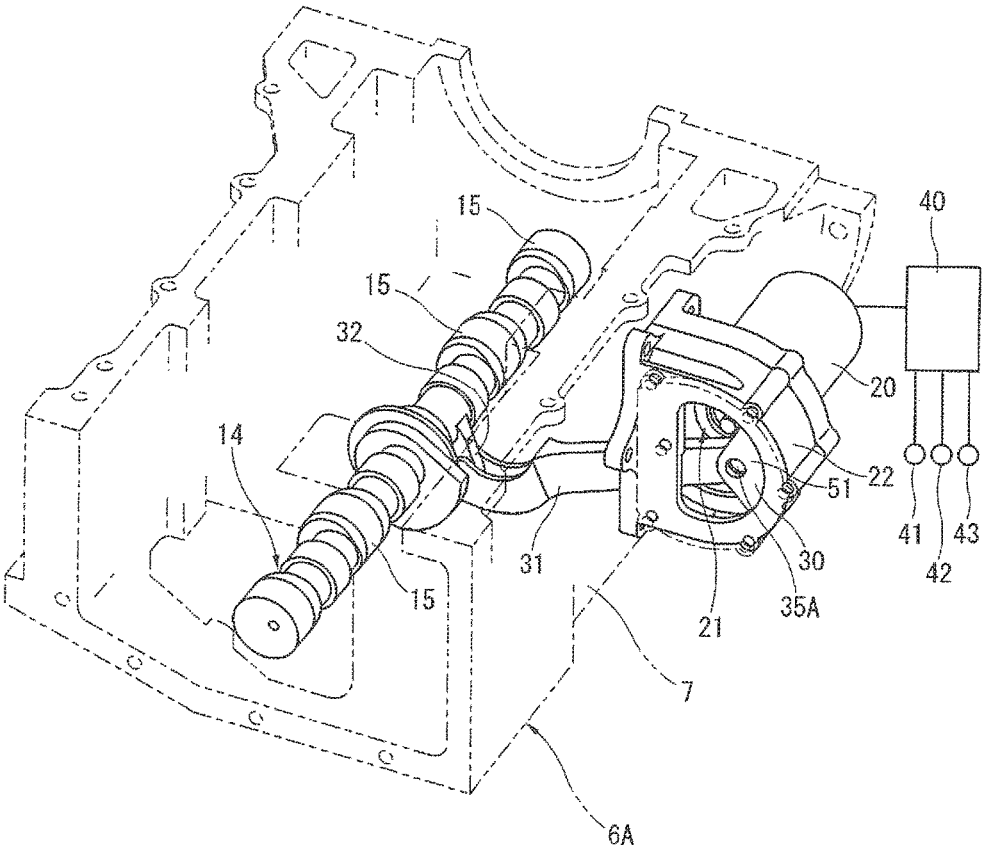
FIG. 2 is a perspective view illustrating a part of a variable compression ratio internal combustion engine equipped with the variable compression ratio mechanism.

As shown in FIGS. 1, 2, the control shaft 14, which is arranged inside of the engine body, and an auxiliary shaft 30 of the connecting mechanism 21, which is arranged inside of the housing 22, are linked together via a lever 31. By the way, in the shown embodiment r the auxiliary shaft 30 is formed integral with an output shaft of a speed reducer (not shown). In lieu thereof, the auxiliary shaft 30 may be configured separately from the output shaft of the speed reducer, such that the auxiliary shaft and the speed-reducer output shaft integrally rotate with each other.

One end of lever 31 and the top end of an arm 32 extending radially outward from the axial central portion of control shaft 14 are linked together through a third connecting pin 33 so as to permit relative rotation between them. The other end of lever 31 and the auxiliary shaft 30 are linked together through a fourth connecting pin 35 so as to permit relative rotation between them. By the way, in FIG. 2, the fourth connecting pin 35 is not shown and omitted, but in lieu thereof a pin connecting hole 35A of auxiliary shaft 30, into which the fourth connecting pin 35 is fitted, is shown. A slit-shaped communication hole, through which the lever 31 is inserted, is formed through the intake-side sidewall 7 of oil-pan upper 6A.

Figure 7:
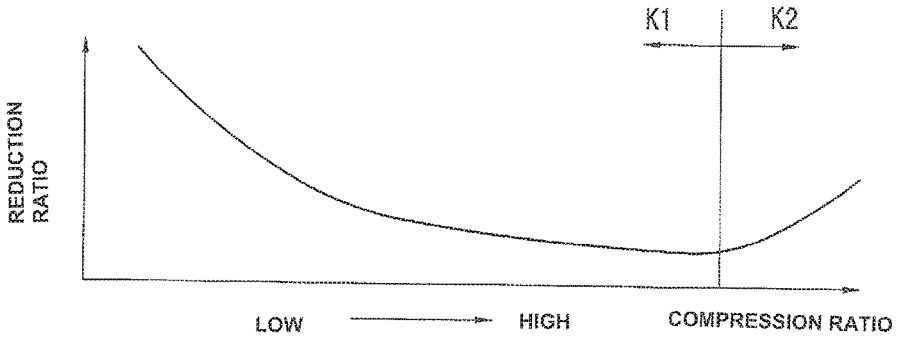
FIG. 7 is an explanatory view illustrating the relation between an engine compression ratio and a reduction ratio of a connecting mechanism.

The connecting mechanism 21 is provided with a speed reducer for reducing a power output (a rotational power) outputted from the drive motor 20 and for transmitting the speed-reduced power to the side of control shaft 14. As a preferable speed reducer, a specific speed, reducer capable of providing high reduction ratios, such as a wave, motion gear device or a cycloid planetary-gear speed reducer, is used. Furthermore, the connecting mechanism is configured such that a reduction ratio, which is provided by a link structure including the lever 31, the arm 32 and the like, changes in accordance with a rotational position of control shaft 14. That is, the engine compression ratio changes by rotating the control shaft 14, and thus the attitude of the link structure including the arm 32 and the lever 31 changes. Owing to the attitude change, a reduction ratio of a rotational power transmission path from the drive motor 20 to the control shaft 14 also changes. Concretely, as shown in FIG. 7, basically, the rotational power transmission path from the drive motor 20 to the control shaft 14 is configured such that the reduction ratio of the rotational power transmission path increases, as the control shaft 14 rotates to a low compression ratio direction. Additionally, near a maximum compression ratio, the rotational power transmission path is configured such that the reduction ratio increases, as the control shaft 14 rotates to a high compression ratio direction.

Figure 3:
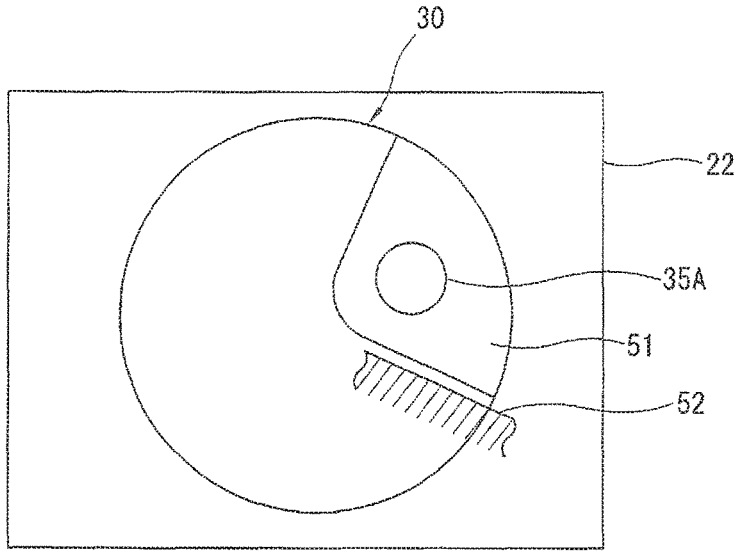
FIG. 3 is an explanatory view schematically illustrating a first movable part and a first stopper provided on a housing.

As shown in FIG. 3, an axially-extending fan-shaped first movable part 51 is integrally formed with the auxiliary shaft 30, which operates in conjunction with the control shaft 14. A first stopper 52 is provided on the housing 22, in which part of the connecting mechanism 21 is housed. The first stopper is provided for mechanically restricting a position of maximum rotation of control shaft 14 in a first rotational direction R1 (see FIG. 4) corresponding to the low compression ratio direction by bringing the first movable part 51 into abutted-engagement with the first stopper 52.

Figure 4:
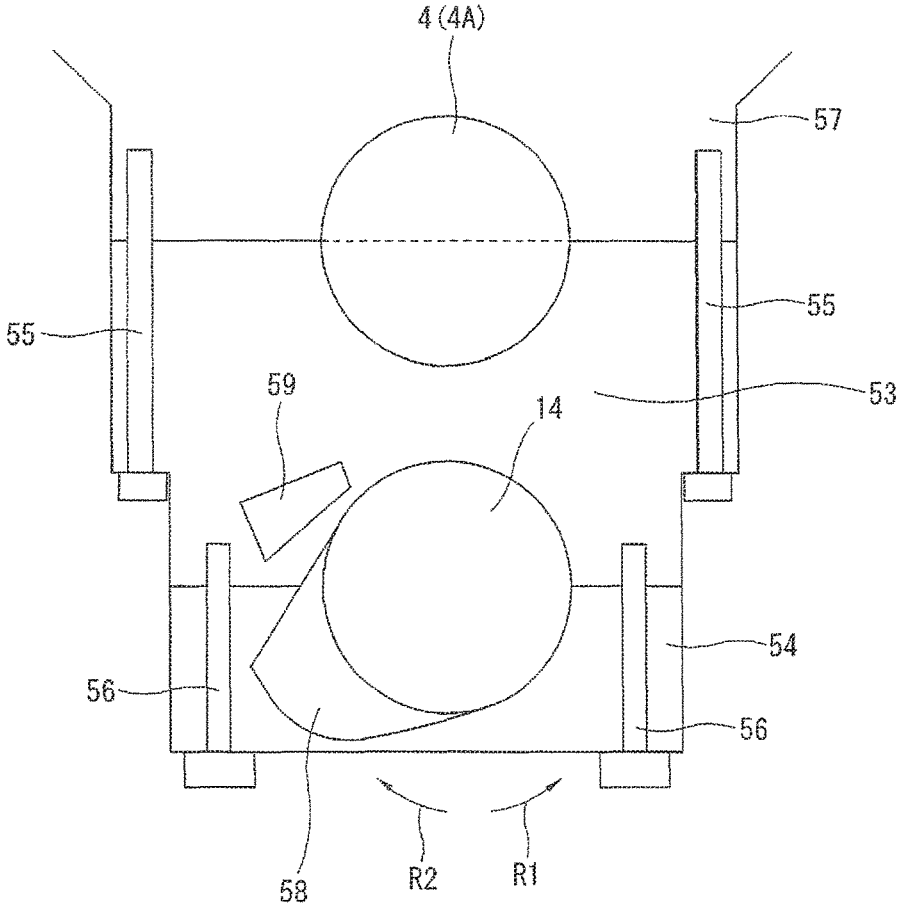
FIG. 4 is an explanatory view schematically illustrating a second movable part and a second stopper provided on a crankshaft bearing part.

Furthermore, as shown in FIG. 4, a bearing cap 53 serving as a crankshaft bearing part and an auxiliary cap 54 are fastened together on a bulkhead 57 of cylinder block 1, serving as part of the engine body, with a plurality of bolts 55, 56. A main journal portion 4A of crankshaft 4 is rotatably supported between the bearing cap 53 and the bulkhead 57. A journal portion of control shaft 14 is rotatably supported between the bearing cap 53 and the auxiliary cap 54. A second movable part 58 is provided on the control shaft 14 in a manner so as to extend radially outward from the control shaft. The second movable part 58 integrally operates together with the control shaft 14. A second stopper 59 is integrally provided on one side face of bearing cap 53 and configured to extend in the axial direction of control shaft 14 such that the second stopper is abuttable with the second movable part 58. The second stopper is provided for mechanically restricting a position of maximum rotation of control shaft 14 in a second rotational direction R2 corresponding to the high compression ratio direction by bringing the second movable part 58 into abutted-engagement with the second stopper 59.

Figure 5:
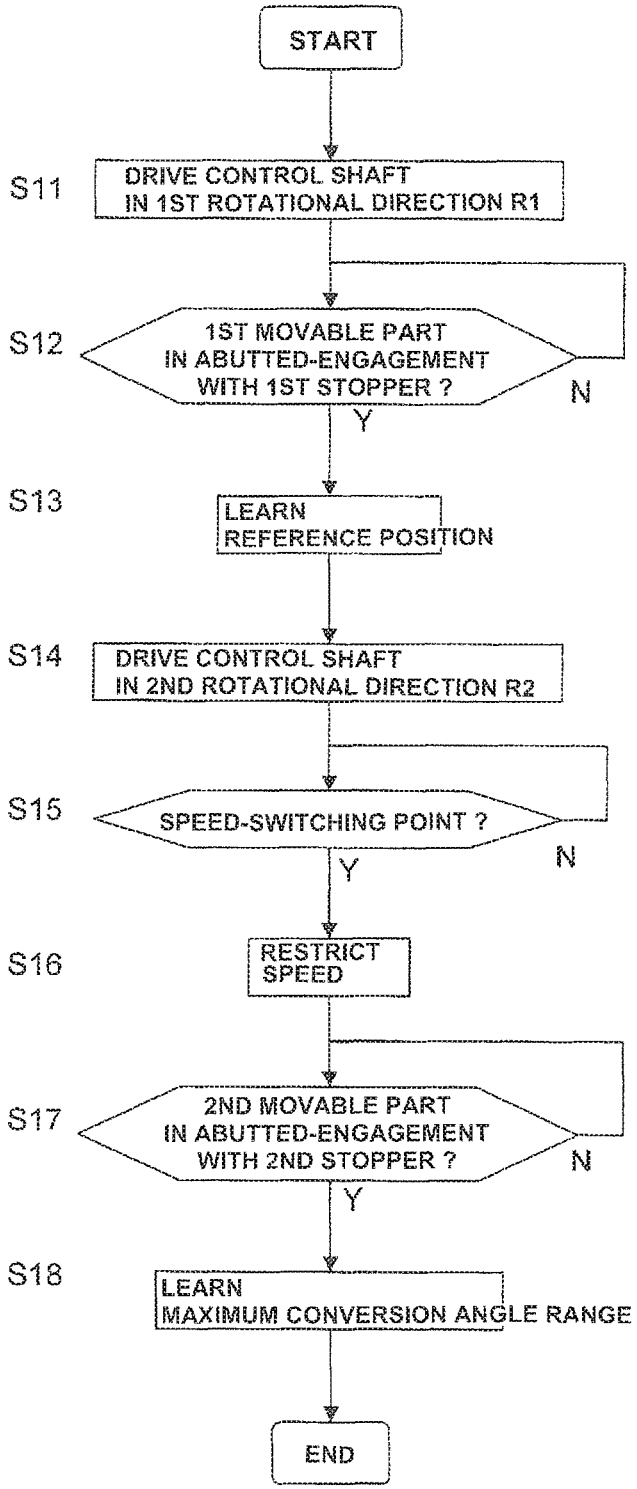
FIG. 5 is a flowchart illustrating the flow of learning control of the embodiment.
Figure 6:
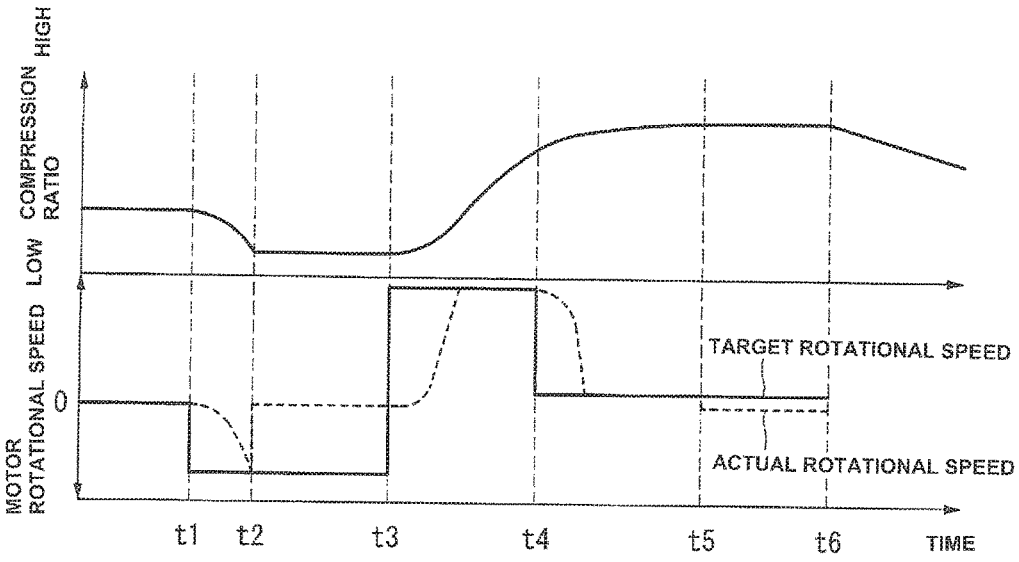
FIG. 6 is a timing chart illustrating operation during learning control in the embodiment.

Next, reference position learning control of the embodiment is explained in detail in reference to FIGS. 5 and 6. The reference position learning control is executed once within an internal combustion engine assembly plant after an internal combustion engine has been assembled. However, such reference position learning control may be executed during operation of the engine, as needed.

First of all, at step S11, control shaft 14 is rotationally driven in the first rotational direction R1 corresponding to the low compression ratio direction by the drive motor 20. The time period, t1-t2 from the time t1 to the time t2 in FIG. 6 represents a state where the control shaft 14 is rotating and shifting to the low compression ratio direction. At this time, the rotational speed of control shaft 14 is not limited, and hence the control shaft 14 is rotationally driven by the drive motor 20 without any torque limit, such that the control shaft 14 rotates at a maximum speed.

At step S12, a check is made to determine whether the first movable part 51 has been brought into abutted-engagement with the first stopper 52 and thus the control shaft 14 has been held at the position of maximum rotation in the first rotational direction R1. For instance, the check may be made simply based on information about whether a given period of time has elapsed from the start of driving of the control shaft 14 in the first rotational direction R1. In lieu thereof, the check may be made based on a detection signal of control shaft sensor 41.

When it is determined that the first movable part 51 has been brought into abutted-engagement with the first stopper 52 and thus the control shaft 14 has been held at the position of maximum rotation in the first rotational direction R1, the routine proceeds from step S12 to step S13. At this step, reference position learning control is executed based on a detection signal of control shaft sensor 41 (see the time period t2-t3 in FIG. 6). In this manner, at the specific position at which the rotational position of control shaft 14 has been mechanically restricted by the first stopper 52, the detection signal of control shaft sensor 41 is learned and corrected. Therefore, it is possible to eliminate the individual difference (operating characteristic difference) of the control shaft sensor 41, thereby improving the detection accuracy of an engine compression ratio.

Immediately after completion of the reference position learning control, the routine proceeds to step S14. At this step, the control shaft 14 is rotationally driven in the second rotational direction R2 corresponding to the high compression ratio direction, which is opposite to the first rotational direction R1. By the way, during the former half (see the time period t3-t4 in FIG. 6) of the transition period to the high compression ratio, the rotational speed (target rotational speed) of control shaft 14 is not limited, and hence the control shaft 14 is rotationally driven by the drive motor 20 without any torque limit, such that the control shaft 14 rotates at a maximum speed.

At step S15, a check is made to determine whether a speed-switching point (see the time t4 in FIG. 6) corresponding to the latter half of the transition period to the high compression ratio has been reached. For instance, the check may be made simply based on information about whether a given period of time has elapsed from the start of the transition period to the high compression ratio. In lieu thereof, the check may be made based on a detection signal of control shaft sensor 41.

Immediately after the speed-switching point has been reached, that is, immediately after a shift to the latter half (see the time period t4-t5 in FIG. 6) of the transition period to the high compression ratio, the routine proceeds from step S15 to step S16. At this step, a driving torque (target rotational speed) of drive motor 20 is limited for the purpose of limiting or restricting the rotational speed of control shaft 14. Hereby, under a state where the rotational speed of control shaft 14 has been limited, the control shaft 14 rotates in the second rotational direction R2 corresponding to the high compression ratio side.

At step S17, a check is made to determine whether the second movable part 58 has been brought into abutted-engagement with the second stopper 59 and thus the control shaft 14 has been held at the position of maximum rotation in the second rotational direction R2. When it is determined that the second movable part 58 has been brought into abutted-engagement with the second stopper 59 and thus the control shaft 14 has been held at the position of maximum rotation in the second rotational direction R2, the routine proceeds from step S17 to step S18. At this step, under a specific state where the position of maximum rotation of control shaft 14 in the second rotational direction R2 has been mechanically restricted by the second stopper 59, learning control of a maximum conversion angle range of control shaft 14 is executed based on a detection signal of control shaft sensor 41 (see the time period t5-t6 in FIG. 6). In this manner, at the specific position at which the rotational position of control shaft 14 has been mechanically restricted by the second stopper 59, the detection signal of control shaft sensor 41 is learned and corrected. Therefore, it is possible to more certainly eliminate the individual difference (operating characteristic difference) of the control shaft sensor 41, thereby improving the detection accuracy of an engine compression ratio.

The specified configuration of the embodiment and its operation and effects are hereunder enumerated.

[1] In the configuration in which a reference position of control shaft 14 is learned in a state where the position of maximum rotation of control shaft 14 in the first rotational direction R1 has been mechanically restricted by the first stopper 52, the first stopper 52 is provided on the housing 22. In this manner, the first stopper 52 is provided on the housing 22 located outside of the engine body, and thus it is less restriction on the layout in comparison with such a case where the first stopper 52 is provided on the bearing cap 53 (the crankshaft bearing part) located in the cylinder block 1 constructing part of the engine body. Hence, it is easy to ensure its sufficient strength and rigidity. Therefore, it is possible to strongly and firmly provide the first, stopper 52. Accordingly, it is unnecessary to slow down a speed of the first movable part for limiting 3, torque when the first movable part 51 is brought into abutted-engagement with the first stopper 52. As a result of this, it is possible to shorten the time duration required for reference position learning without deteriorating the reference position learning accuracy.

Figure 8:
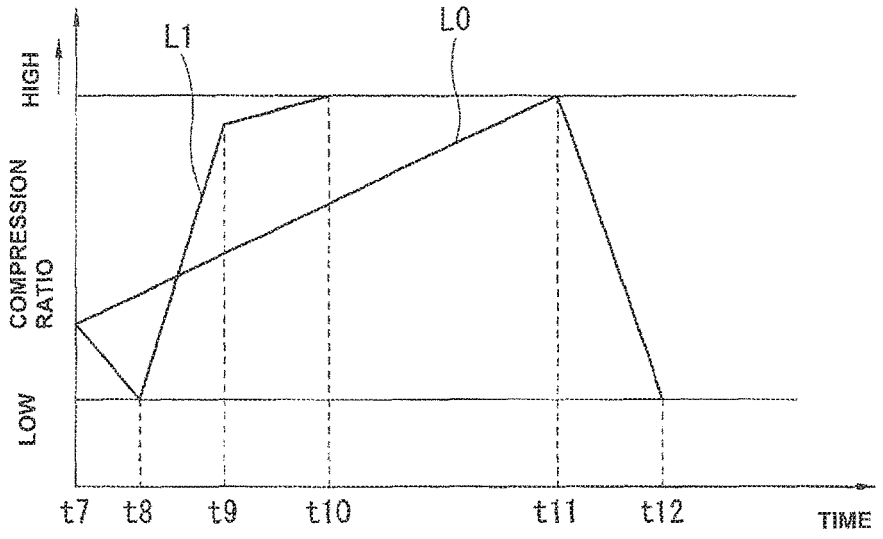
FIG. 8 is a timing chart illustrating the learning-time difference between the embodiment and a comparative example.

Additionally, the variable compression ratio internal combustion engine has the second stopper 59 for mechanically restricting the position of maximum rotation of control shaft 14 in the second rotational direction R2 opposite to the first rotational direction R1 by bringing the second movable part 58, which operates in conjunction with the control shaft 14, into abutted-engagement with the second stopper. The variable compression ratio internal combustion engine is configured such that a maximum conversion angle range of control shaft 14 is learned in a state where the position of maximum rotation of control shaft 14 in the second rotational direction R2 has been mechanically restricted by the second stopper 59. By learning and correcting the maximum conversion angle range of control shaft 14 as discussed above, it is possible to more certainly eliminate the individual difference (operating characteristic difference) of control shaft sensor 41, and consequently to improve the detection accuracy of an engine compression ratio. Hereupon, the second stopper 59 is provided on the bearing cap 53 located inside of the engine body. The provision of the second stopper inside of the engine body contributes to fewer link parts intervening between the second stopper 59 and the piston 3, in comparison with such a case where the second stopper 59 is provided outside of the engine body. Thus, it is possible to improve the reference position learning accuracy. Referring to FIG. 8, there is shown the timing chart illustrating the learning-time difference between the embodiment expressed by a characteristic L1 and the comparative example expressed by a characteristic L0. For the sake of clarity, the time duration, during which learning is actually executed, is omitted. As shewn in FIG. 8, at the time t7 corresponding to a learning control starting point, the rotational position of control shaft 14 is unidentified. As seen in the comparative example expressed by the characteristic L0, suppose that, first of all, the control shaft 14 rotates in the second rotational direction R2 (i.e., the high compression ratio direction), and then the control shaft 14 rotates in the first rotational direction R1 (i.e., the low compression ratio direction). In such a case, in order to limit a torque when the second movable part 58 is brought into abutted-engagement with the second stopper 59 provided on the bearing cap 53, a speed of the drive motor 20 has to be restricted immediately after the start of driving of the drive motor 20, that is, immediately after the time t7. This is because rotating parts that rotate together with the crankshaft 4, such as the crank pin 5, counterweights and the like, exist, around the bearing cap 53 located inside of the engine body, and thus restrictions on the layout are severe. Therefore, it is difficult to sufficiently ensure the strength and rigidity of the second stopper 59 provided on the bearing cap 53. For this, reason, when the second movable part 58 is brought into abutted-engagement with the second stopper 59, there is a necessity of restricting a speed. Therefore, it takes a long time to bring the second movable part 58 into abutted-engagement with the second stopper 59 (see the time period t7-t11). Thus, the time until completion of learning becomes very long.

In contrast to the above, in the embodiment expressed by the characteristic L1, first of all, a reference position of control shaft 14 is learned in a state where the position of maximum rotation of control shaft 14 in the first rotational direction R1 has been mechanically restricted by the first stopper 52, and then a maximum conversion angle range of control shaft 14 is learned in a state where the position of maximum rotation of control shaft 14 in the second rotational direction R2 has been mechanically restricted by the second stopper 59. That is, first of all, the control shaft 14 is rotationally driven in the first rotational direction R1, and then the control shaft is rotationally driven in the second rotational direction R2. Hereupon, the first stopper 52, which is located on the side of the first rotational direction R1, is provided on the strong housing 22, and thus it is unnecessary to restrict a speed of the drive motor 20. That is to say, when the control shaft 14 is, first, driven in the first rotational direction R1, it is unnecessary to restrict a speed of the drive motor 20. Therefore, the time period (t7-t8) until the first movable part 51 is brought into abutted-engagement with the first stopper 52 can be shortened. After this, when the control shaft 14 is rotationally driven in the second rotational direction R2, the rotation driving of control shaft 14 to the second rotational direction R2 is started from a specific state where the first movable part 51 is kept in abutted-engagement with the first stopper. Hence, at the early stage (t8-t9) of rotation driving, it is unnecessary to perform any speed restriction of the drive motor 20. As a result of this, it is possible to greatly shorten the time (t7-t10) until completion of learning.

[2] Furthermore, the second stopper 59 is provided on the bearing cap 53 serving as the crankshaft bearing part. In this manner, a stopper position such that learning of the maximum conversion angle range is executed is structured as the bearing cap located near the control shaft 14. Hence, it is possible to improve the learning accuracy.

[3] However, rotating parts that rotate together with the crankshaft 4, such as the crank pin 5, counterweights and the like, exist around the bearing cap 53 located inside of the cylinder block 1, and thus restrictions on the layout are severe. Therefore, it is impossible to strongly provide the second stopper 59 with a sufficient durability. For this reason, when the second movable part 58 is brought into abutted-engagement with the second stopper 59 in order to learn the maximum conversion angle range, the operating speed of the drive motor 20 is restricted for the purpose of torque suppression at the time of abutted-engagement (see the late stage (t9-t10) of rotation driving of control shaft 14 in the second rotational direction R2 in FIG. 8). Hereby, the second stopper 59 is provided on the bearing cap 53, but it is possible to ensure the desired learning accuracy.

As shown in FIG. 7, a rotational power transmission path from the drive motor 20 to the control shaft 14 is configured such that a reduction ratio of the rotational power transmission path changes in order of large, small, and large, as the control shaft 14 rotates from a low compression ratio side to a high compression ratio side. Also, the second movable part 58 is configured to come into abutted-engagement with the second stopper 59 within a section K2 in which the reduction ratio is changing from small to large. Furthermore, when the second movable part 58 is brought into abutted-engagement with the second stopper 59 in order to learn the maximum conversion angle range, the operating speed of the drive motor 20 is restricted within the section K2 after the reduction ratio has switched from small to large.

Assuming that the speed of the drive motor 20 is restricted within a section K1 in which the reduction ratio is changing from large to small, the reduction ratio decreases, as the control shaft 14 rotates in the second rotational direction R2 (in the high compression ratio direction), and thus torque transmitted from the drive motor 20 to the control shaft 14 also decreases. In such a case, there is a possibility that the second movable part 58 undesirably stops in the middle of operation owing to friction of each parts.

In the shown embodiment, the speed of the drive motor 20 is restricted within the section K2 after the reduction ratio has been switched from small to large. Hence, the reduction ratio increases, as the control shaft 14 rotates in the second rotational direction R2 (in the high compression ratio direction), and thus torque transmitted from the drive motor 20 to the control shaft 14 also increases. Accordingly, it is possible to suppress the second movable part 58 from undesirably stopping prior to abutted-engagement of the second movable part with the second stopper 59, even with a speed restriction, thereby enhancing the reliability of learning control.

[5] The variable compression ratio mechanism is configured such that the engine compression ratio increases, as the control shaft rotates in the first rotational direction R1, and that the engine compression ratio decreases, as the control shaft rotates in the second rotational direction R2. As discussed above, the second stopper 59 on the side of the high compression ratio direction, which requires a high accuracy in order to suppress knocking and pre-ignition from occurring, is provided on the bearing cap 53 near the piston 3 and the control shaft 14. Therefore, it is possible to ensure a high learning accuracy on the high compression ratio side, thereby satisfactorily suppressing knocking and pre-ignition from occurring.

While the foregoing is a description of the concrete embodiments carried out the invention, it will be understood that the invention is not limited to the particular embodiments shown and described herein, but that various changes and modifications may be made. For instance, in the shown embodiment, the first rotational direction R1 is set as a low compression ratio direction, whereas the second rotational direction R2 is set as a high compression ratio direction. On the contrary, the first rotational direction R1 may be set as a high compression ratio direction, whereas the second rotational direction R2 may be set as a low compression ratio direction.

REFERENCE SIGNS LIST

1 . . . Cylinder block
4 . . . Crankshaft
10 . . . Variable compression ratio mechanism
14 . . . Control shaft
20 . . . Drive motor
21 . . . Connecting mechanism
22 . . . Housing
51 . . . First movable part
52 . . . First stopper
53 . . . Bearing cap (Crankshaft bearing part)
58 . . . Second movable part
53 . . . Second stopper

The invention claimed is:

1. A learning method for a variable compression ratio internal combustion engine having a variable compression ratio mechanism capable of changing an engine compression ratio in accordance with a rotational position of a control shaft, a drive motor for changing and holding the rotational position of the control shaft, a first stopper provided outside of an engine body for mechanically restricting a position of maximum rotation of the control shaft in a first rotational direction by bringing a first movable part, which operates in conjunction with the control shaft, into abutted-engagement with the first stopper, and a second stopper provided inside of the engine body for mechanically restricting a position of maximum rotation of the control shaft in a second rotational direction opposite to the first rotational direction by bringing a second movable part, which operates in conjunction with the control shaft, into abutted-engagement with the second stopper, comprising:

learning a reference position of the control shaft in a state where the position of maximum rotation of the control shaft in the first rotational direction has been mechanically restricted by the first stopper; and learning a maximum conversion angle range of the control shaft in a state where the position of maximum rotation of the control shaft in the second rotational direction has been mechanically restricted by the second stopper, after the reference position of the control shaft has been learned.

2. The learning method for the variable compression ratio internal combustion engine as recited in claim 1, wherein:

the variable compression ratio internal combustion engine further includes a crankshaft bearing part for rotatably supporting a crankshaft, and the second stopper is provided on the crankshaft bearing part.

3. The learning method for the variable compression ratio internal combustion engine as recited in claim 1, wherein:

an operating speed of the drive motor is restricted when the second movable part is brought into abutted-engagement with the second stopper in order to learn the maximum conversion angle range.

4. The learning method for the variable compression ratio internal combustion engine as recited in claim 1, wherein:

a rotational power transmission path from the drive motor to the control shaft is configured such that a reduction ratio of the rotational power transmission path changes in order of large, small, and large, as the control shaft rotates from a low compression ratio side to a high compression ratio side; and the operating speed of the drive motor is restricted after the reduction ratio has switched from small to large when the second movable part is brought into abutted-engagement with the second stopper in order to learn the maximum conversion angle range.

5. The learning method for the variable compression ratio internal combustion engine as recited in claim 1, wherein:

the variable compression ratio mechanism is configured such that (i) the engine compression ratio increases, as the control shaft rotates in the first rotational direction, and (ii) the engine compression ratio decreases, as the control shaft rotates in the second rotational direction.

* * * * *